US007299718B2

(12) United States Patent
Hsieh

(10) Patent No.: US 7,299,718 B2
(45) Date of Patent: Nov. 27, 2007

(54) MULTI-FOLDING SCREWDRIVER

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/230,770

(22) Filed: Sep. 21, 2005

(65) Prior Publication Data

US 2007/0062338 A1 Mar. 22, 2007

(51) Int. Cl.
*B25G 3/02* (2006.01)
*B25G 1/00* (2006.01)
*B25G 23/16* (2006.01)

(52) U.S. Cl. ..... 81/28; 81/177.7; 81/58.3; 81/73

(58) Field of Classification Search ..... 81/28, 81/37, 73, 177.7, 58.3, 177.8, 436
See application file for complete search history.

(56) References Cited

U.S. PATENT DOCUMENTS 299,424 A * 5/1884 Sohemmel ..... 81/28
1,713,434 A * 5/1929 Harrold ..... 81/28
1,772,524 A * 8/1930 Seidemann ..... 81/58.3
2,443,339 A * 6/1948 Blalock ..... 81/28
2,712,765 A * 7/1955 Knight, Jr. ..... 81/58.3
4,334,445 A * 6/1982 Timewell ..... 81/177.7
5,280,740 A * 1/1994 Ernst ..... 81/177.7
5,349,886 A * 9/1994 Jin ..... 81/37
6,234,049 B1 * 5/2001 Ju et al. ..... 81/177.7

* cited by examiner

*Primary Examiner*—Hadi Shakeri

(57) ABSTRACT

A multi-folding screwdriver comprises a handle having a retainer formed therein; the retainer having a receiving space; a bottom end of the receiving space being installed with a first engaging portion; at least one via hole being formed in the retainer; a positioning element passing through the via hole; a driving bar being a multi-staged and bendable rod; a bottom end of the driving bar having a second engaging portion corresponding to the first engaging portion; an annular recessed limiting portion being formed at the driving bar. The driving bar is received in the receiving space so that the first engaging portion of the retainer is engaged to the second engaging portion. Thereby the retainer and the driving bar can rotate; and the positioning element passes through the via hole to resist against the limiting portion so as to forth as a limiting device.

6 Claims, 6 Drawing Sheets

MULTI-FOLDING SCREWDRIVER

FIELD OF THE INVENTION

The present invention relates to screwdrivers, and in particular to a multi-folding screwdriver with a rotatable screwdriver. By that, the screwdriver with multiple folds can be operated effectively by changing the orientation of the driving bar of the screwdriver. The present invention provides an effective engaging device which make the driving bar of the screwdriver can change orientation easily.

BACKGROUND OF THE INVENTION

The prior art driving bar has a pivotal portion which make the driving bar bendable to form a multiple folding portion so that the driving bar can be used to driver the screw at some locations which is difficult to be arrived by the general straight driving bar. Since when the driving bar is blended, the arm of force of the driving bar becomes small. This is because that the driving bar is bent to have a rectangular shape. This induces that the force applied to the screwdriver cannot be effectively transferred to the driving head of the driving bar.

In another prior art, the driving bar has two pivotal portions so that the driving bar has two sections which can folded. This design can generate a more effective structure, which causes that the force can be transferred to the driving head with a great arm of force. However this prior art still has the following disadvantages.

The connection between the handle and the driving bar is weak so that it is easily released. Thereby the screwdriver cannot effectively drive a screw. Furthermore, the middle part of driving bar has two pivotal portions which connect the front and distal end of the driving bar. However the pivotal portions generate weak points in driving. Furthermore, the force applied to the screwdriver will disperse in the pivotal portions.

SUMMARY OF THE INVENTION

Accordingly, the primary object of the present invention is to provide a multi-folding screwdriver with a rotatable screwdriver head. By that, the screwdriver with multiple folds can be operated effectively by changing the orientation of the driving bar of the screwdriver. The present invention provides an effective engaging device which makes the driving bar of the screwdriver can change orientation easily.

To achieve above objects, the present invention provides a multi-folding screwdriver with a rotatable driving bar which comprises a handle having a retainer formed therein; the retainer having a receiving space; a bottom end of the receiving space being installed with a first engaging portion; at least one via hole being formed in the retainer; a positioning element passing through the via hole; a driving bar being a multi-staged and bendable rod; a bottom end of the driving bar having a second engaging portion corresponding to the first engaging portion; an annular recessed limiting portion being formed at the driving bar. The driving bar is received in the receiving space so that the first engaging portion of the retainer is engaged to the second engaging portion. Thereby the retainer and the driving bar can rotate; then the positioning element passes through the via hole to resist against the limiting portion so as to form as a limiting device.

The various objects and advantages of the present invention will be more readily understood from the following detailed description when read in conjunction with the appended drawing.

BRIEF DESCRIPTION OF THE DRAWINGS

FIG. 3(*b*) is another plane view of the multi-folding screwdriver of the present invention, wherein the screwdriver is folded into three different stages.

FIG. 5(*b*) is another cross sectional view of the second embodiment, wherein the driving bar is lifted for changing orientation.

FIG. 6(*b*) is another cross sectional view of the third embodiment, wherein the driving bar is lifted for changing orientation.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figures 1, 2:
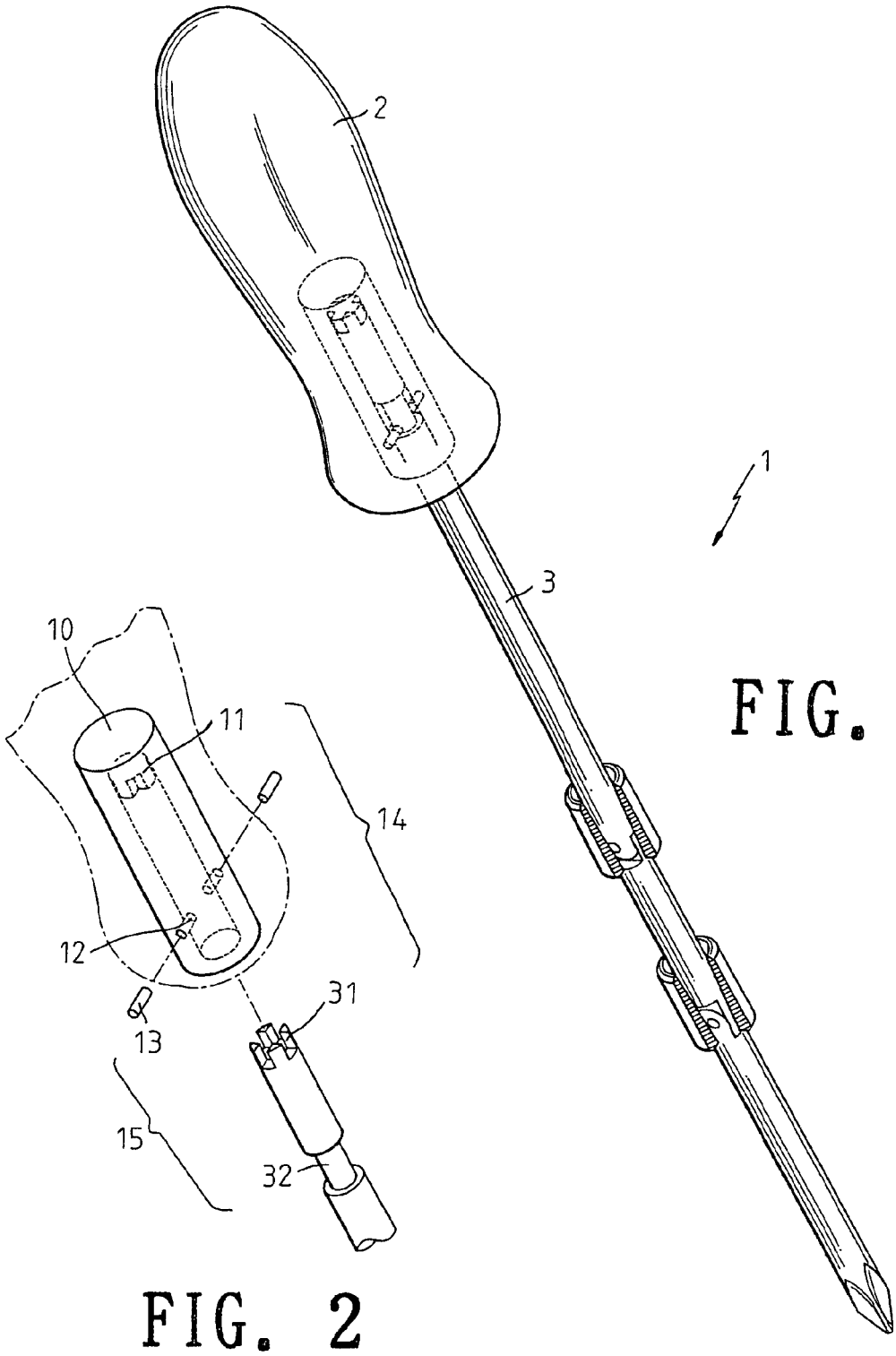
FIG. 1 is a perspective view of multi-folding screwdriver of the present invention.
FIG. 2 is an partial exploded perspective view of the multi-folding screwdriver of the present invention, wherein the structure of the engaging device and the limiting device are clearly illustrated.
Figure 3A:
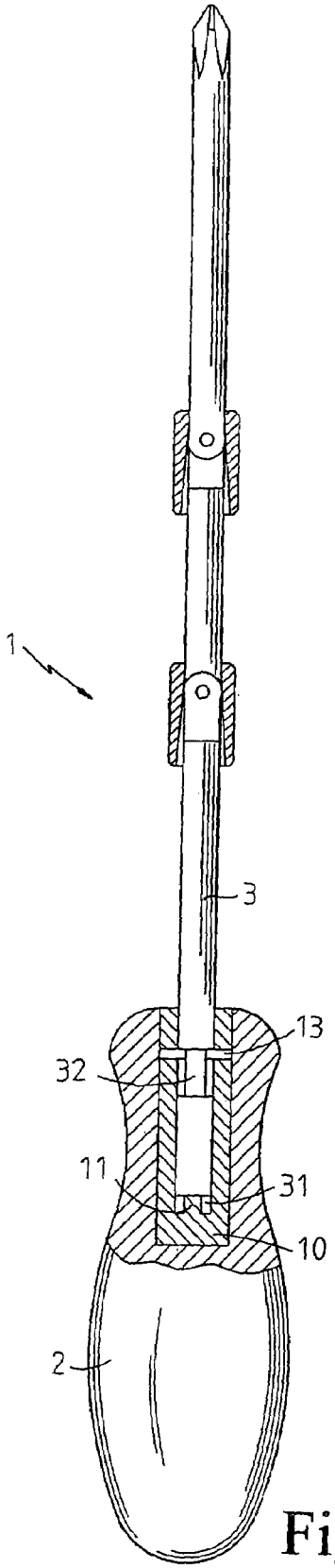
FIG. 3(*a*) is a plane view of the multi-folding screwdriver of the present invention, wherein the screwdriver is in an unfolded state.
Figure 3B:
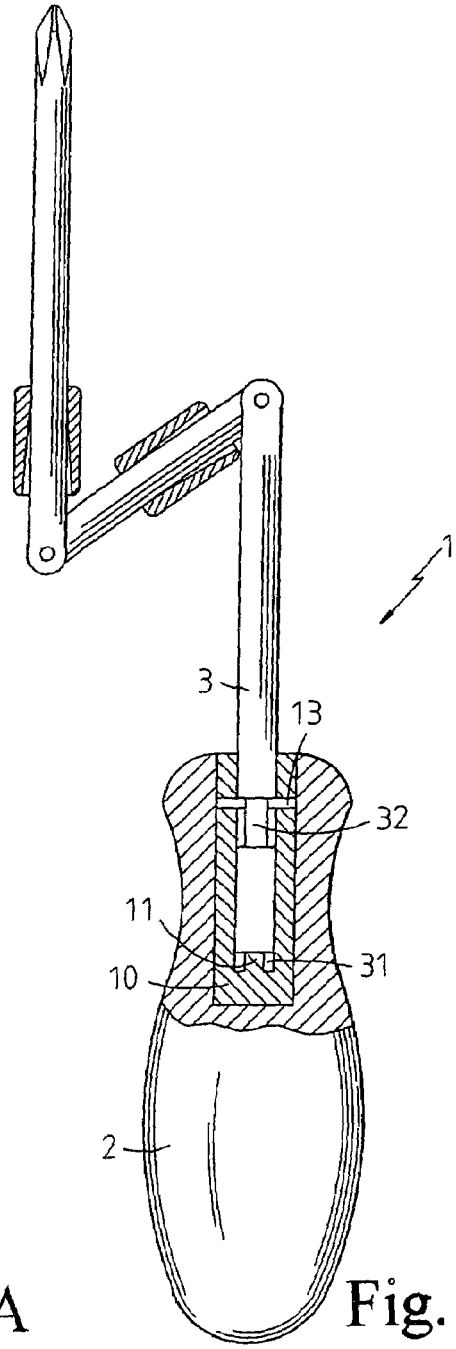

With reference to FIGS. 1, 3(*a*), 3(*b*) and 4, the rotatable screwdriver of the present invention is illustrated. The rotatable screwdriver has the following elements.

A handle 2 has a retainer 10 formed therein. The retainer 10 has a receiving space. A bottom end of the receiving space is installed with a first engaging portion 11. At least one via hole 12 is formed in the retainer 10. A positioning element 13 passes through the via hole 12.

A driving bar 3 is a multi-staged and bendable rod. A bottom end of the driving bar 3 has a second engaging portion 31 corresponding to the first engaging portion 11. An annular recessed limiting portion 32 is formed at the driving bar 3.

In the embodiment illustrated in FIG. 2, there are two via holes 12 and the positioning element 13 is formed by two posts 13. The two posts 13 pass through the via holes 12 to be inserted into the limiting portion 32. The limiting portion 32 is an annular recess. The longitudinal length of the limiting portion 32 is greater than a size of each post 13 so that driving bar 3 is movable with the confinement of the longitudinal length of the limiting portion 32.

In assembly, referring to FIGS. 1 and 2, the driving bar 3 is received in the receiving space so that the first engaging portion 11 of the retainer 10 is engaged to the second engaging portion 31 of the driving bar 3 so as to form an engaging device 14. Thereby the retainer 10 and the driving bar 3 can rotate synchronously. Then the positioning element 13 passes through the via hole 12 to resist against the limiting portion 32 so as to form a limiting device 15. Thereby the driving bar 3 is movable longitudinally within the limiting of the limiting portion 32.

Referring to FIGS. 3(*a*) and 3(*b*), the front end of the driving bar 3 is a multi-stage structure. That is the driving bar 3 has a plurality of pivotal portions which make the driving bar 3 bendable to form a multiple folding portions so that the driving bar 3 can be used to driver the screw at some locations which is difficult to be arrived by the general straight driving bar 3.

Figure 4:
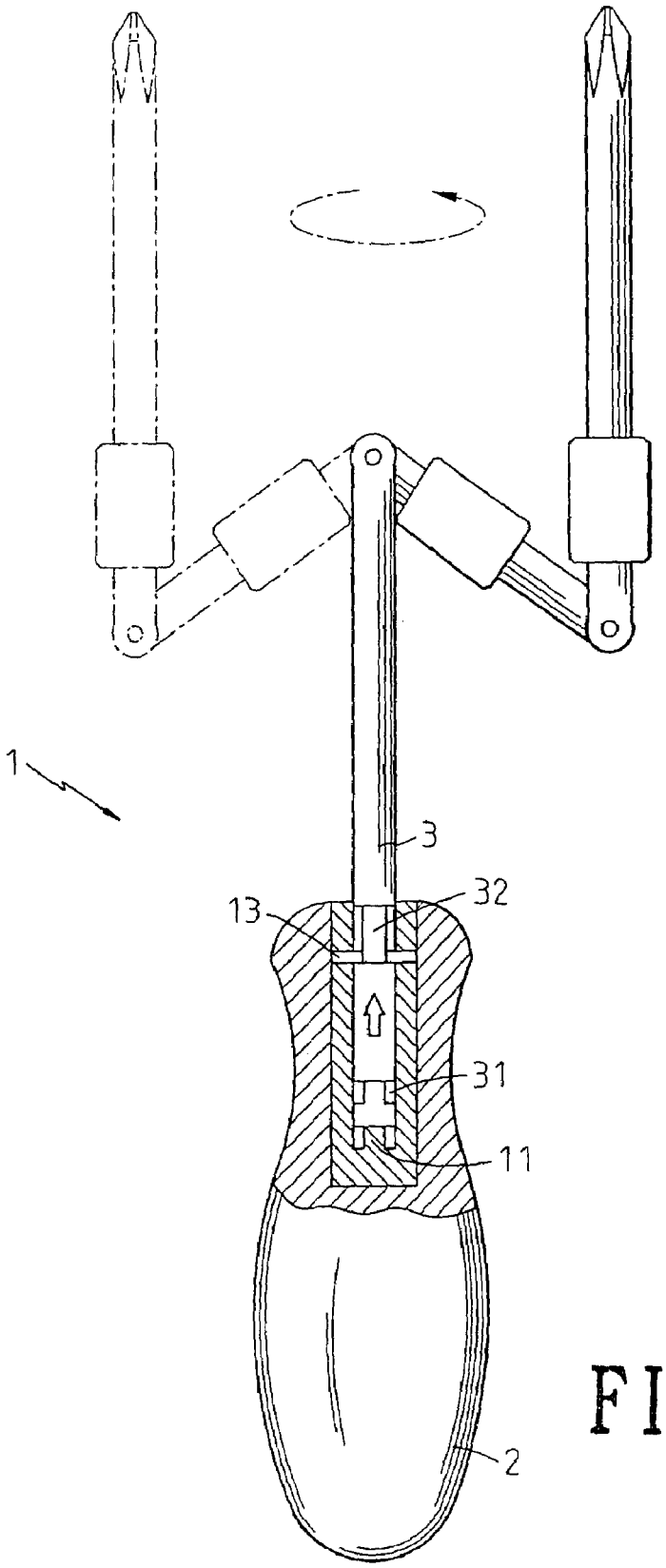
FIG. 4 shows one embodiment of the present invention, wherein the operation of changing orientation of the driving bar of the present invention is illustrated.

Referring to FIG. 4, in some uses, it is necessary to change the orientation of the driving bar 3. Firstly, the driving bar 3 can be moved forwards so that the second engaging portion 31 at the bottom of the driving bar 3 is separated from the first engaging portion 11. Thus, the engaging between the first engaging portion 11 and the second engaging portion 31 is released. Then the driving bar 3 is rotated to change the force applied direction of the screwdriver. Then the driving bar 3 moves backwards so that the first engaging portion 11 is engaged to the second engaging portion 31. Then she rotatable screwdriver can be used again.

The main feature of the present invention is that by the design of the present invention, the orientation of the driving bar 3 of the present invention is changeable. In the prior art, since when the driving bar 3 is bended, the arm of force of the driving bar 3 becomes small. By the design of the present invention, the orientation of the present invention is changeable. Furthermore, by the limiting device 15 and engaging device 14 of the present invention, the orientation of the driving bar 3 is changeable by moving the driving bar 3 longitudinally. Thereby the multi-folding screwdriver of the present invention is usable.

Figure 5A:
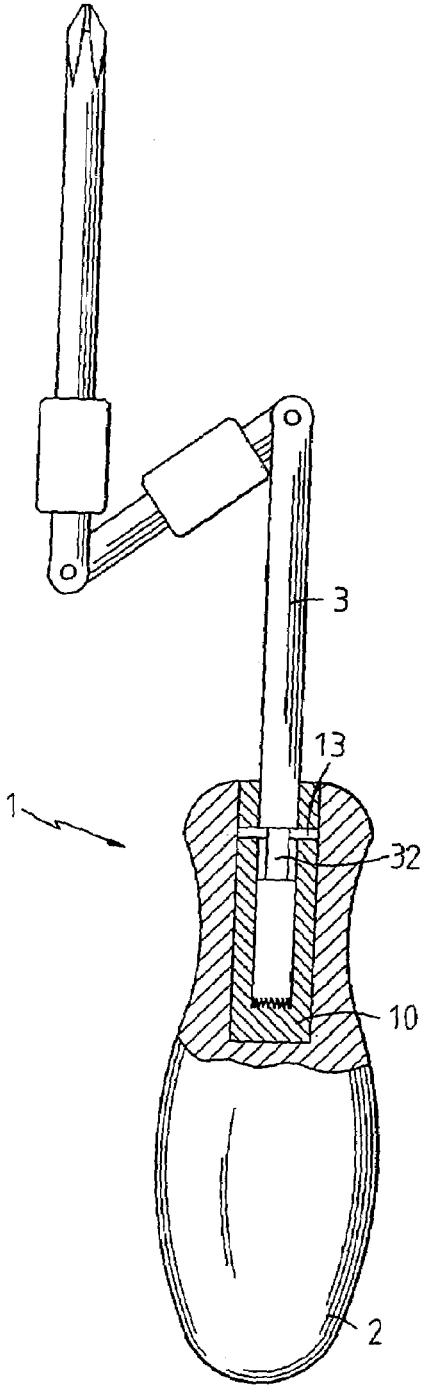
FIG. 5(*a*) is a cross sectional view of the second embodiment of the present invention, wherein the first engaging portion and second engaging portion are teethed.
Figure 5B:
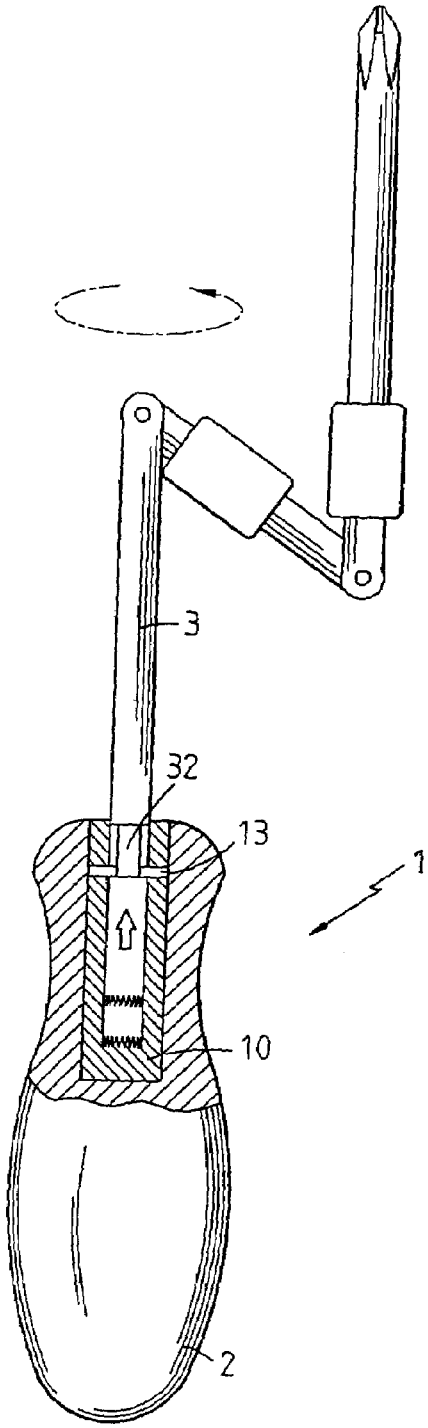

Referring to FIGS. 5(*a*), 5(*b*) and 7, it is illustrated that the first engaging portion 11 and second engaging portion 31 have teeth surfaces.

Figure 6A:
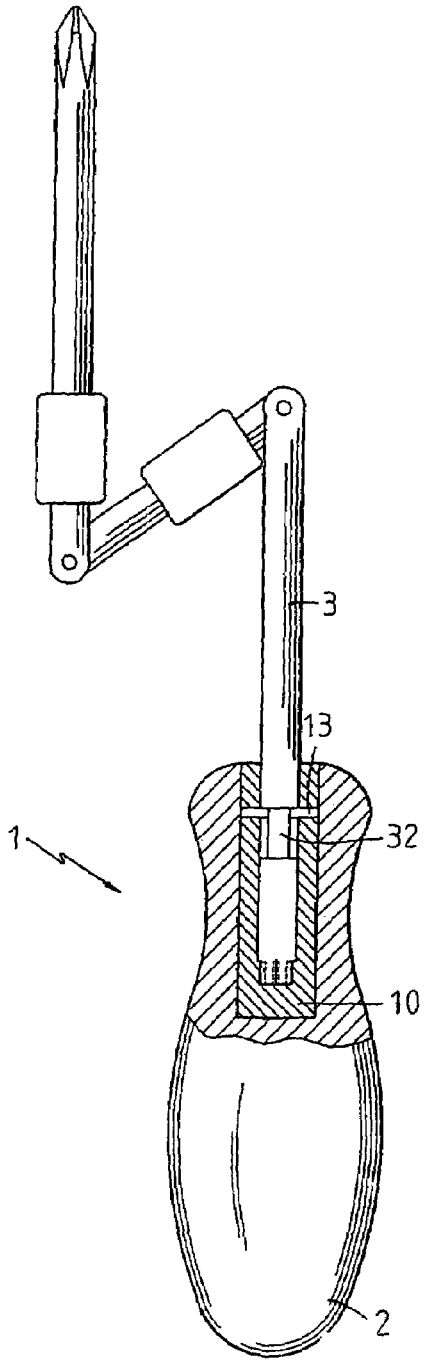
FIG. 6(*a*) is a cross sectional view about the third embodiment of the present invention, wherein the first engaging portion and second engaging portion have wave-like structure.
Figure 6B:
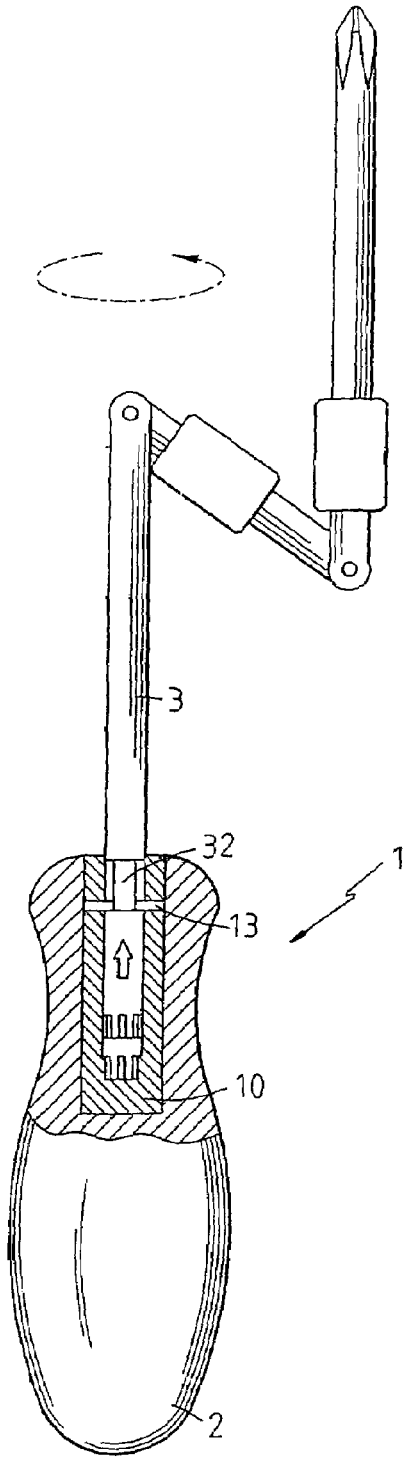
Figure 7:
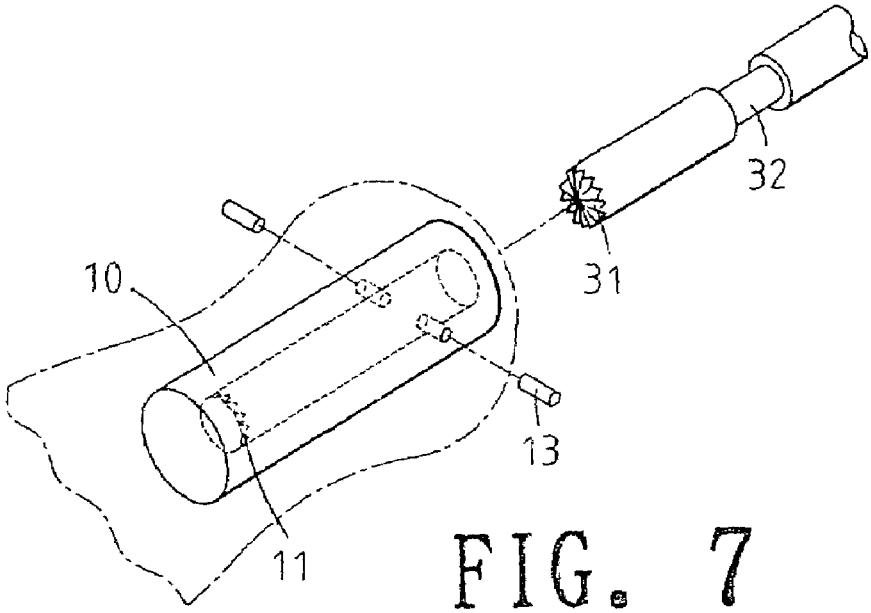
FIG. 7 is an exploded a perspective view about the second embodiment of the present invention, wherein the structure of the engaging device and the limiting device are clearly illustrated.
Figure 8:
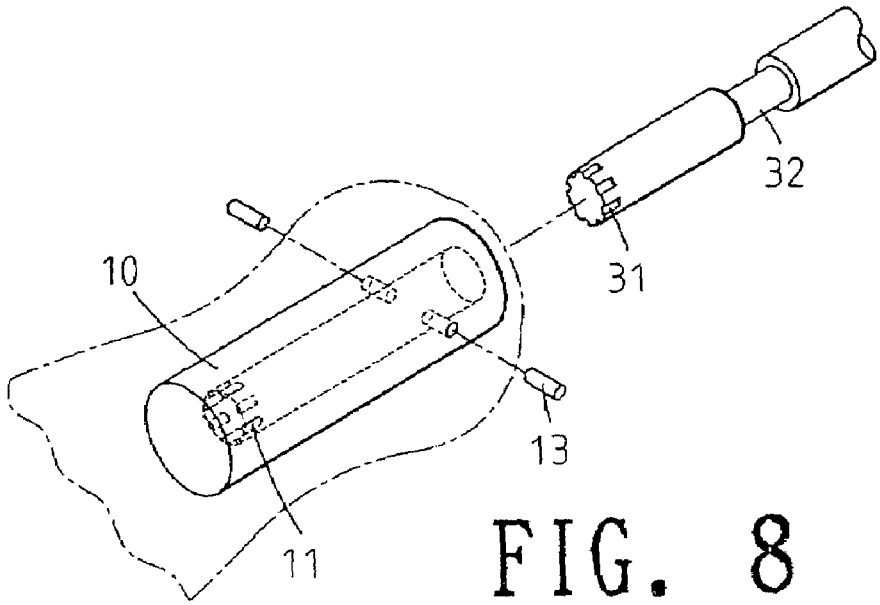
FIG. 8 is a perspective view about the third embodiment of the present invention, wherein the structure of the engaging device and the limiting device are clearly illustrated

Referring to FIGS. 6(*a*), 6(*b*) and 8, it is illustrated that the first engaging portion 11 and second engaging portion 31 have wheel-like structure with a plurality of convex portions and a plurality of concave portions which are arranged at the lateral sides and are arranged alternatively.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A multi-folding screwdriver with a rotatable driving bar, the screwdriver having a multi-folding driving bar; comprising:

a handle having a retaining space formed therein;

a retainer inserted in said retaining space such that the retainer is enclosed within said handle; the retainer having a receiving space; a bottom end of the receiving space being installed with a first engaging portion; at least one via hole being formed in the retainer;

at least one positioning element inserted through the at least one via hole;

a driving bar being a multi-staged and bendable rod received in the receiving space; a bottom end of the driving bar having a second engaging portion corresponding to the first engaging portion; the driving bar including an annular recess forming an annular recessed limiting portion defining upper and lower annular shoulders; the positioning element passes through the via hole extending into the limiting portion to resist against the limiting portion to form as a limiting device by engaging said shoulders; the longitudinal length of the limiting portion being greater than a size of the positioning element so that driving bar is movable within the confinement of the longitudinal length of the limiting portion;

wherein when the driving bar is moved to a first position the first engaging portion of the retainer is engaged with the second engaging portion of the driving bar so as to form an engaging device; thereby the retainer and the driving bar can rotate; and wherein at least one sleeve enclosing the driving bar for confining bending action of the stage of the driving bar.

2. The multi-folding screwdriver of claim 1, wherein the first engaging portion and second engaging portion have teeth surfaces.

3. The multi-folding screwdriver of claim 1, wherein the first engaging portion and second engaging portion have wheel-like structure with a plurality of convex portions and a plurality of concave portions which are arranged at the lateral sides and are arranged alternatively.

4. The multi-folding screwdriver of claim 1, wherein there are two via holes and the positioning element is formed by two posts.

5. The multi-folding screwdriver of claim 4, wherein the first engaging portion and second engaging portion have teeth surfaces.

6. The multi-folding screwdriver of claim 4, wherein the first engaging portion and second engaging portion have wheel-like structure with a plurality of convex portions and a plurality of concave portions which are arranged at the lateral sides and are arranged alternatively.

* * * * *